US008374365B2

(12) United States Patent
Goodwin et al.

(10) Patent No.: US 8,374,365 B2
(45) Date of Patent: Feb. 12, 2013

(54) SPATIAL AUDIO ANALYSIS AND SYNTHESIS FOR BINAURAL REPRODUCTION AND FORMAT CONVERSION

(75) Inventors: Michael M. Goodwin, Scotts Valley, CA (US); Jean-Marc Jot, Aptos, CA (US); Mark Dolson, Ben Lomond, CA (US)

(73) Assignee: Creative Technology Ltd, Singapore (SG)

( * ) Notice: Subject to any disclaimer, the term of this patent is extended or adjusted under 35 U.S.C. 154(b) by 1106 days.

(21) Appl. No.: 12/243,963

(22) Filed: Oct. 1, 2008

(65) Prior Publication Data

US 2009/0252356 A1 Oct. 8, 2009

Related U.S. Application Data

(63) Continuation-in-part of application No. 11/750,300, filed on May 17, 2007.

(60) Provisional application No. 60/977,345, filed on Oct. 3, 2007, provisional application No. 61/102,002, filed on Oct. 1, 2008, provisional application No. 60/747,532, filed on May 17, 2006.

(51) Int. Cl.
*H04R 5/02* (2006.01)

(52) U.S. Cl. ..... 381/310; 381/17; 381/22; 381/23; 704/500; 704/501; 704/502; 704/503; 704/200.1

(58) Field of Classification Search ..... 381/1, 17–18, 381/309–310, 22–23; 704/500–501, 502–503, 704/200.1

See application file for complete search history.

(56) References Cited

U.S. PATENT DOCUMENTS

| | | | | |
|---|---|---|---|---|
| 3,777,076 | A | 12/1973 | Takahashi | |
| 5,633,981 | A | 5/1997 | Davis | |
| 5,857,026 | A | 1/1999 | Scheiber | |
| 5,890,125 | A * | 3/1999 | Davis et al. | 704/501 |
| 6,487,296 | B1 | 11/2002 | Allen et al. | |
| 6,684,060 | B1 | 1/2004 | Curtin | |
| 7,853,022 | B2 * | 12/2010 | Thompson et al. | 381/17 |
| 7,970,144 | B1 * | 6/2011 | Avendano et al. | 381/1 |
| 2004/0223622 | A1 | 11/2004 | Lindemann et al. | |
| 2005/0053249 | A1 | 3/2005 | Wu et al. | |
| 2005/0190928 | A1 | 9/2005 | Noto | |
| 2006/0106620 | A1 | 5/2006 | Thompson et al. | |
| 2006/0153155 | A1 | 7/2006 | Jacobsen et al. | |
| 2006/0159280 | A1 | 7/2006 | Iwamura | |
| 2007/0087686 | A1 | 4/2007 | Holm et al. | |
| 2007/0211907 | A1 | 9/2007 | Eo et al. | |
| 2008/0002842 | A1 * | 1/2008 | Neusinger et al. | 381/119 |
| 2008/0085676 | A1 | 4/2008 | Huang | |
| 2008/0097750 | A1 | 4/2008 | Seefeldt et al. | |
| 2008/0205676 | A1 | 8/2008 | Merimaa et al. | |
| 2008/0267413 | A1 | 10/2008 | Faller | |
| 2009/0067640 | A1 | 3/2009 | McCarty et al. | |
| 2009/0081948 | A1 | 3/2009 | Banks et al. | |
| 2009/0129601 | A1 * | 5/2009 | Ojala et al. | 381/1 |
| 2009/0150161 | A1 * | 6/2009 | Faller | 704/500 |

FOREIGN PATENT DOCUMENTS

WO 2007/031896 A1 3/2007

OTHER PUBLICATIONS

Christof Faller, 'Parametric Coding of Spatial Audio', Proc. of the 7th Int. Conf. DAFx'04, Napoles, Italy, Oct. 5-8, 2004.

* cited by examiner

*Primary Examiner* — Disler Paul
(74) *Attorney, Agent, or Firm* — Creative Technology Ltd

(57) ABSTRACT

A frequency-domain method for format conversion or reproduction of 2-channel or multi-channel audio signals such as recordings is described. The reproduction is based on spatial analysis of directional cues in the input audio signal and conversion of these cues into audio output signal cues for two or more channels in the frequency domain.

12 Claims, 6 Drawing Sheets

FIG. 4A
(prior art)
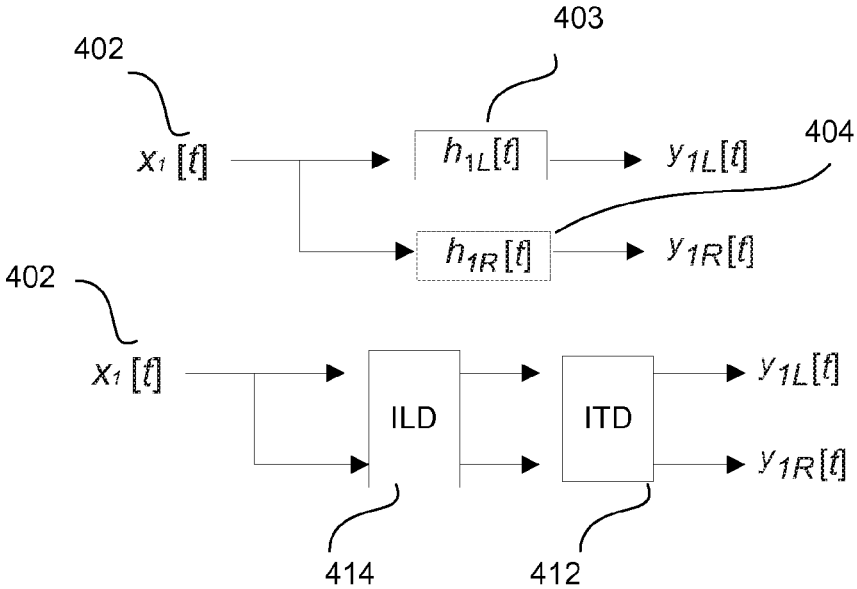
FIG. 4B
(prior art)
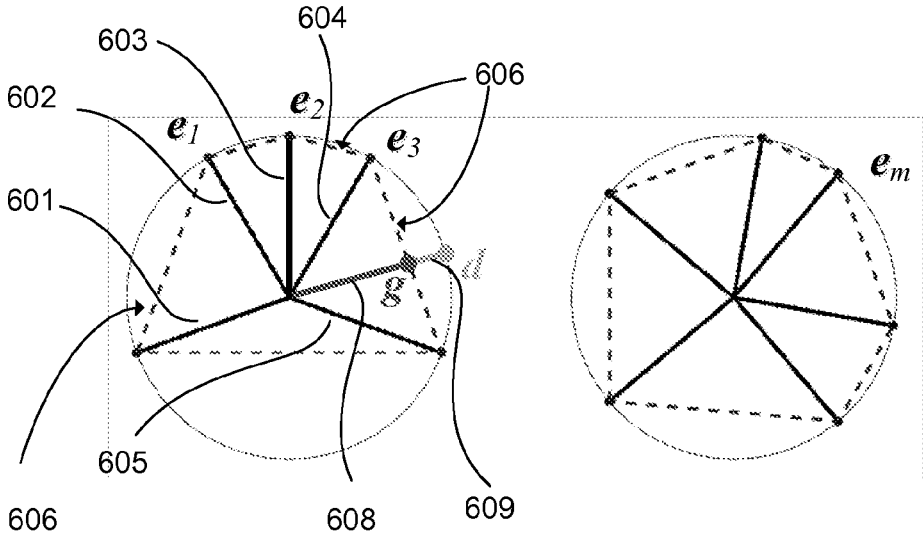
FIG. 6A FIG. 6B

SPATIAL AUDIO ANALYSIS AND SYNTHESIS FOR BINAURAL REPRODUCTION AND FORMAT CONVERSION

CROSS-REFERENCES TO RELATED APPLICATIONS

This application claims priority to, incorporates by reference, and is a continuation-in-part of the disclosure of U.S. patent application Ser. No. 11/750,300, filed May 17, 2007, titled "Spatial Audio Coding Based on Universal Spatial Cues", which claims priority to and the benefit of the disclosure of U.S. Provisional Application No. 60/747,532, filed May 17, 2006, the disclosure of which is further incorporated by reference herein. Further, this application claims priority to and the benefit of the disclosure of U.S. Provisional Patent Application Ser. No. 60/977,345, filed on Oct. 3, 2007, and entitled "SPATIAL AUDIO ANALYSIS AND SYNTHESIS FOR BINAURAL REPRODUCTION", the entire specification of which is incorporated herein by reference.

This application is related to, claims priority to and the benefit of, and incorporates by reference the disclosure of copending U.S. Patent Application Ser. No. 61/102,002 and entitled Phase-Amplitude 3-D Stereo Encoder and Decoder, filed Oct. 1, 2008.

BACKGROUND OF THE INVENTION

1. Field of the Invention

The present invention relates to audio processing techniques. More particularly, the present invention relates to methods for providing spatial cues in audio signals.

2. Description of the Related Art

Virtual 3D audio reproduction of a 2-channel or multi-channel recording traditionally aims at reproducing over headphones the auditory sensation of listening to the recording over loudspeakers. The conventional method consists of "virtualizing" each of the source channels by use of HRTF (Head Related Transfer Function) filters or BRIR (Binaural Room Impulse Response) filters. A drawback of this technique is that a sound source that is partially panned across channels in the recording is not convincingly reproduced over headphones, because it is rendered through the combination of HRTFs for two or more different directions instead of the correct HRTF for the desired direction.

What is desired is an improved method for reproducing over headphones the directional cues of a two-channel or multi-channel audio signal.

SUMMARY OF THE INVENTION

The present invention provides an apparatus and method for binaural rendering of a signal based on a frequency-domain spatial analysis-synthesis. The nature of the signal may be, for instance, a music or movie soundtrack recording, the audio output of an interactive gaming system, or an audio stream received from a communication network or the internet. It may also be an impulse response recorded in a room or any acoustic environment, and intended for reproducing the acoustics of this environment by convolution with an arbitrary source signal.

In one embodiment, a method for binaural rendering of an audio signal having at least two channels each assigned respective spatial directions is provided. The original signal may be provided in any multi-channel or spatial audio recording format, including the Ambisonic B format or a higher-order Ambisonic format; Dolby Surround, Dolby prologic or any other phase-amplitude matrix stereo format; Dolby Digital, DTS or any discrete multi-channel format; and conventional 2-channel or multi-channel recording obtained by use of an array of 2 or more microphones (including binaural recordings).

The method includes converting the signal to a frequency-domain or subband representation, deriving in a spatial analysis a direction for each time-frequency component, and generating left and right frequency-domain signals such that, for each time and frequency, the inter-channel amplitude and phase differences between these two signals matches the inter-channel amplitude and phase differences present in the HRTF corresponding to the direction angle derived from the spatial analysis.

In accordance with another embodiment, an audio output signal is generated which has at least first and second audio output channels. The output channels are generated from a time-frequency signal representation of an audio input signal having at least one audio input channel and at least one spatial information input channel. A spatial audio output format is selected. Directional information corresponding to each of a plurality of frames of the time-frequency signal representation are received. First and second frequency domain signals are generated from the time frequency signal representation that, at each time and frequency, have inter-channel amplitude and phase differences between the at least first and second output channels, the amplitude and phase differences characterizing a direction in the selected spatial audio output format.

In accordance with yet another embodiment, a method of generating audio output signals is provided. An input audio signal, preferably having at least two channels is provided. The input audio signal is converted to a frequency domain representation. A directional vector corresponding to the localization direction of each of a plurality of time frequency components is derived from the frequency domain representation. First and second frequency domain signals are generated from the time frequency signal representation that, at each time and frequency, have inter-channel amplitude and phase differences that characterize the direction that corresponds to the directional vector. An inverse transform is performed to convert the frequency domain signals to the time domain.

While the present invention has a particularly advantageous application for improved binaural reproduction over headphones, it applies more generally to spatial audio reproduction over headphones or loudspeakers using any 2-channel or multi-channel audio recording or transmission format where the direction angle can be encoded in the output signal by frequency-dependent or frequency-independent inter-channel amplitude and/or phase differences, including an Ambisonic format; a phase-amplitude matrix stereo format; a discrete multi-channel format; conventional 2-channel or multi-channel recording obtained by use of an array of 2 or more microphones; 2-channel or multi-channel loudspeaker 3D audio using HRTF-based (or "transaural") virtualization techniques; and sound field reproduction using loudspeaker arrays, including Wave Field Synthesis.

As is apparent from the above summary, the present invention can be used to convert a signal from any 2-channel or multi-channel spatial audio recording or transmission format to any other 2-channel or multi-channel spatial audio format. Furthermore, the method allows including in the format conversion an angular transformation of the sound scene such as a rotation or warping applied to the direction angle of sound components in the sound scene. These and other features and advantages of the present invention are described below with reference to the drawings.

BRIEF DESCRIPTION OF THE DRAWINGS

FIG. 4A is a block diagram of a time-domain virtualization process for one of the input channels illustrated in FIG. 3.

FIG. 4B is block-diagram of the time-domain virtualization process illustrated in FIG. 4A.

FIG. 6A depicts format vectors for a standard 5-channel audio format and the corresponding encoding locus of the Gerzon vector in accordance with one embodiment of the present invention.

FIG. 6B depicts format vectors for an arbitrary 6-channel loudspeaker layout and the corresponding encoding locus of the Gerzon vector in accordance with one embodiment of the present invention.

DETAILED DESCRIPTION OF PREFERRED EMBODIMENTS

Figure 1:
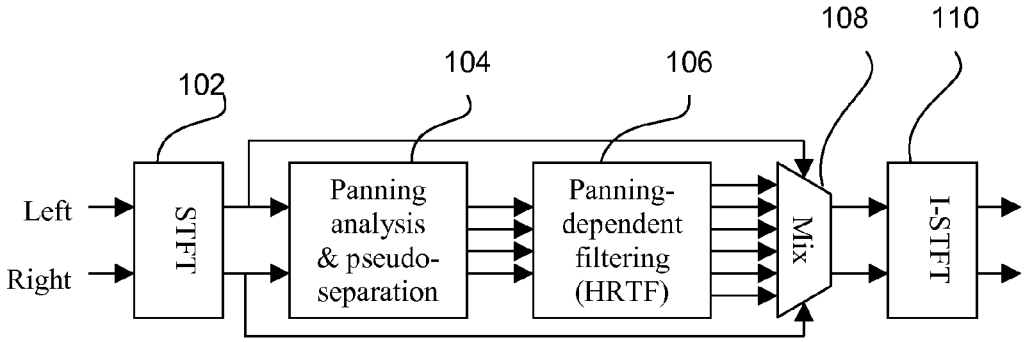
FIG. 1 is a flowchart illustrating a stereo virtualization method in accordance with one embodiment of the present invention.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

The present invention provides frequency-domain methods for headphone reproduction of 2-channel or multi-channel recordings based on spatial analysis of directional cues in the recording and conversion of these cues into binaural cues or inter-channel amplitude and/or phase difference cues in the frequency domain. This invention incorporates by reference the details provided in the disclosure of the invention described in the U.S. patent application Ser. No. 11/750,300, and entitled "Spatial Audio Coding Based on Universal Spatial Cues", filed on May 17, 2007, which claims priority from Application 60/747,532, the entire disclosures of which are incorporated by reference in their entirety.

This invention uses the methods described in the patent application U.S. Ser. No. 11/750,300 (incorporated by reference herein) to analyze directional cues in the time-frequency domain. This spatial analysis derives, for each time-frequency component, a direction angle representative of a position relative to the listener's head. Binaural rendering includes generating left and right frequency-domain signals such that, for each time and frequency, the binaural amplitude and phase differences between these two signals matches the binaural amplitude and phase differences present in the HRTF corresponding to the direction angle derived from the spatial analysis. It is straightforward to extend the method to any 2-channel or multi-channel spatial rendering method where the due direction of sound is characterized by prescribed inter-channel amplitude and/or phase differences.

For the frequency-domain spatial audio coding framework, several variations of the direction vector cues are provided in different embodiments. These include unimodal, continuous, bimodal primary-ambient with non-directional ambience, bimodal primary-ambient with directional ambience, bimodal continuous, and multimodal continuous. In the unimodal embodiment, one direction vector is provided per time-frequency tile. In the continuous embodiment, one direction vector is provided for each time-frequency tile with a focus parameter to describe source distribution and/or coherence.

In another embodiment, i.e., the bimodal primary-ambient with non-directional ambience, for each time-frequency tile, the signal is decomposed into primary and ambient components; the primary (coherent) component is assigned a direction vector; the ambient (incoherent) component is assumed to be non-directional and is not represented in the spatial cues. A cue describing the direct-ambient energy ratio for each tile is also included if that ratio is not retrievable from the downmix signal (as for a mono downmix). The bimodal primary-ambient with directional ambience embodiment is an extension of the above case where the ambient component is assigned a distinct direction vector.

In a bimodal continuous embodiment, two components with direction vectors and focus parameters are estimated for each time-frequency tile. In a multimodal continuous embodiment, multiple sources with distinct direction vectors and focus parameters are allowed for each tile. While the continuous and multimodal cases are of interest for generalized high-fidelity spatial audio coding, listening experiments suggest that the unimodal and bimodal cases provide a robust basis for a spatial audio coding system.

According to one embodiment, a method of generating an audio output signal having at least first and second audio output channels from a time-frequency signal representation of an audio input signal having at least one audio input channel and at least one spatial information input channel is provided. The method includes selecting a spatial audio output format such that a direction in the audio output signal is characterized by at least one of an inter-channel amplitude difference and an inter-channel phase difference at each frequency between the at least first and second audio output channels. The method further includes receiving an ambient directional vector corresponding to at least one ambient component of the audio input signal, receiving a time-frequency representation of ambient components corresponding to the audio input signal, and using the ambient directional vector and ambient components to generate the first and second frequency domain output signals that, at each time and frequency, have inter-channel amplitude and phase differences between the at least first and second audio output channels that characterize a direction in the spatial audio output format.

With the proliferation of portable media devices, headphone listening has become increasingly common; in both mobile and non-mobile listening scenarios, providing a high-fidelity listening experience over headphones is thus a key value-add (or arguably even a necessary feature) for modem consumer electronic products. This enhanced headphone reproduction is relevant for stereo content such as legacy music recordings as well as multi-channel music and movie soundtracks. While algorithms for improved headphone listening might incorporate dynamics processing and/or transducer compensation, the described embodiments of the invention are concerned with spatial enhancement, for which the goal is ultimately to provide the headphone listener with an immersive experience.

Recently, some "spatially enhanced" headphones incorporating multiple transducers have become commercially available. Although the methods described herein could be readily extended to such multi-transducer headphones, the preferred embodiments of the invention are directed to the more common case of headphone presentation wherein a single transducer is used to render the signal to a given ear: the headphone reproduction simply constitutes presenting a left-channel signal to the listener's left ear and likewise a right-channel signal to the right ear. In such headphone systems, stereo music recordings (still the predominant format) can obviously be directly rendered by routing the respective channel signals to the headphone transducers. However, such rendering, which is the default practice in consumer devices, leads to an in-the-head listening experience, which is counter-productive to the goal of spatial immersion: sources panned between the left and right channels are perceived to be originating from a point between the listener's ears. For audio content intended for multi-channel surround playback (perhaps most notably movie soundtracks), typically with a front center channel and multiple surround channels in addition to front left and right channels, direct headphone rendering calls for a downmix of these additional channels; in-the-head localization again occurs, as for stereo content, and furthermore the surround spatial image is compromised by elimination of front/back discrimination cues.

Figure 3:
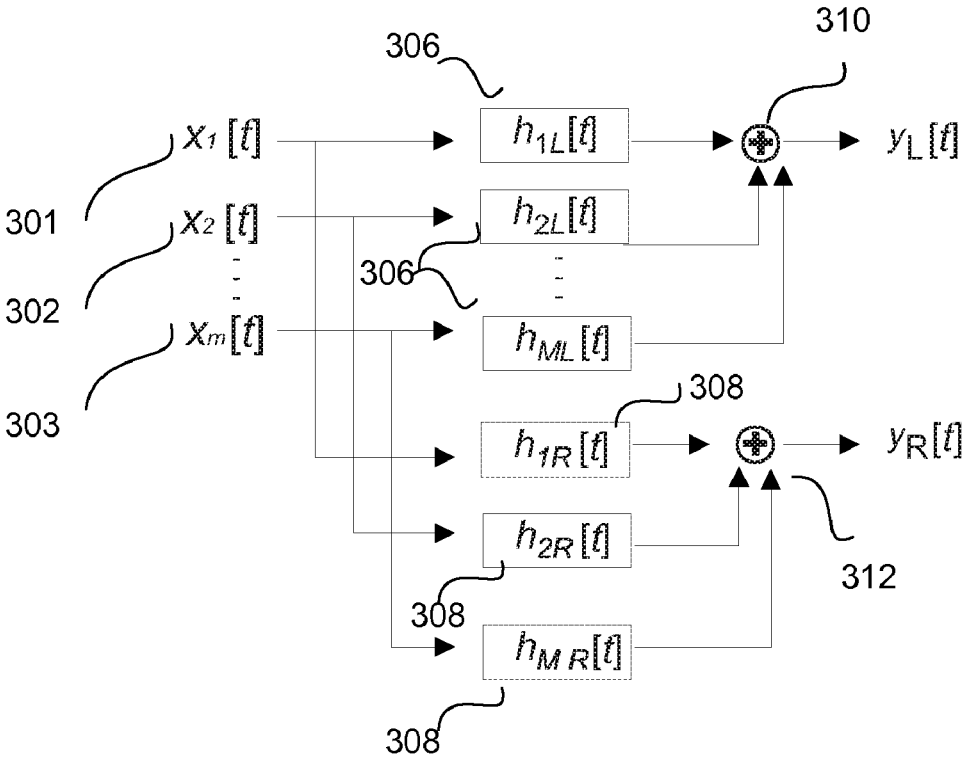
FIG. 3 (prior art)
FIG. 3 is a block diagram of standard time-domain virtualization based on HRTFs or BRTFs.

In-the-head localization, though commonly experienced by headphone listeners, is certainly a physically unnatural percept, and is, as mentioned, contrary to the goal of listener immersion, for which a sense of externalization of the sound sources is critical. A technique known as virtualization is commonly used to attempt to mitigate in-the-head localization and to enhance the sense of externalization. The goal of virtualization is generally to recreate over headphones the sensation of listening to the original audio content over loudspeakers at some pre-established locations dictated by the audio format, e.g. +/−30° azimuth (in the horizontal plane) for a typical stereo format. This is achieved by applying position-dependent and ear-dependent processing to each input channel in order to create, for each channel, a left ear and a right-ear signal (i.e. a binaural signal) that mimic what would be received at the respective listener's ears if that particular channel signal were broadcast by a discrete loudspeaker at the corresponding channel position indicated by the audio format. The binaural signals for the various input channels are mixed into a two-channel signal for presentation over headphones, as illustrated in FIG. 3.

Standard visualization methods have been applied to music and movie listening as well as interactive scenarios such as games. In the latter case, where the individual sound sources are explicitly available for pre-processing, a positionally accurate set of head-related transfer functions (HRTFs, or HRIRs for head-related impulse responses) can be applied to each source to create an effective binaural rendering of multiple spatially distinct sources. In the music (or movie) playback scenario, however, discrete sound sources are not available for such source-specific spatial processing; the channel signals consist of a mixture of the various sound sources. In one embodiment of the present invention, we address this latter case of listening to content for which exact positional information of the constituent sources is not known a priori—so discrete virtualization of the individual sound sources cannot be carried out. It should be noted, however, that the proposed method also applies to interactive audio tracks mixed in multi-channel formats, as in some gaming consoles.

In standard virtualization of audio recordings, a key drawback is that a sound source that is partially panned across channels in the recording is not convincingly reproduced over headphones—because the source is rendered through the combination of HRTFs for multiple (two in the stereo case) different directions instead of via the correct HRTFs for the due source direction. In the new approach presented in various embodiments of the invention, a spatial analysis algorithm, hereafter referred to as spatial audio scene coding (SASC), is used to extract directional information from the input audio signal in the time-frequency domain. For each time and frequency, the SASC spatial analysis derives a direction angle and a radius representative of a position relative to the center of a listening circle (or sphere); the angle and radius correspond to the perceived location of that time-frequency component (for a listener situated at the center). Then, left and right frequency-domain signals are generated based on these directional cues such that, at each time and frequency, the binaural magnitude and phase differences between the synthesized signals match those of the HRTFs corresponding to the direction angle derived by the SASC analysis—such that a source panned between channels will indeed be processed by the correct HRTFs.

The following description begins with a more detailed review of standard virtualization methods and of their limitations, introducing the notations used in the subsequent description of the preferred embodiments, which includes: a new virtualization algorithm that overcomes the drawbacks of standard methods by using SASC spatial analysis-synthesis, the SASC spatial analysis, the SASC-driven binaural synthesis, and an extension where the input is separated into primary and ambient components prior to the spatial analysis-synthesis.

Standard Virtualization Methods:

In the following sections, we review standard methods of headphone virtualization, including time-domain and frequency-domain processing architectures and performance limitations.

Time-domain Virtualization:

Virtual 3-D audio reproduction of a two-channel or multi-channel recording traditionally aims at reproducing over headphones the auditory sensation of listening to the recording over loudspeakers. The conventional method, depicted in FIG. 3, consists of "virtualizing" each of the input channels (301-303) via HRTF filters (306, 308) or BRIR/BRTF (binaural room impulse response/transfer function) filters and then summing the results (310, 312).

$$Y_L[t] = \sum_m h_{mL}[t] * x_m[t] \tag{1}$$

$$Y_R[t] = \sum_m h_{mR}[t] * x_m[t] \tag{2}$$

where m is a channel index and $X_m[t]$ is the m-th channel signal. The filters $h_{mL}[t]$ and $h_{mR}[t]$ for channel m are dictated by the defined spatial position of that channel, e.g. ±30° azimuth for a typical stereo format; the filter $h_{mL}[t]$ represents the impulse response (transfer function) from the m-th input position to the left ear, and $h_{mR}[t]$ the response to the right ear. In the HRTF case, these responses depend solely on the morphology of the listener, whereas in the BRTF case they also incorporate the effect of a specific (real or modeled) reverberant listening space; for the sake of simplicity, we refer to these variants interchangeably as HRTFs for the remainder of this specification (although some of the discussion is more strictly applicable to the anechoic HRTF case).

The HRTF-based virtualization for a single channel is depicted in FIG. 4A. FIG. 4A is a block diagram of a time-domain virtualization process for one of the input channels. The HRTF filters shown in FIG. 4A can be decomposed into an interaural level difference (ILD) and an interaural time difference (ITD). The filters $h_{1L}[t]$ (403) and $h_{1R}R[t]$ (404) as explained above, describe the different acoustic filtering that the signal $X_1[t]$ (402) undergoes in transmission to the respective ears. In some approaches, the filtering is decomposed into an interaural time difference (ITD) and an interaural level difference (ILD), where the ITD essentially captures the different propagation delays of the two acoustic paths to the ears and the ILD represents the spectral filtering caused by the listener's presence.

Virtualization based on the ILD/ITD decomposition is depicted in FIG. 4B; this binaural synthesis achieves the virtualization effect by imposing interaural time and level differences on the signals to be rendered, where the ITDs and ILDs are determined from the desired virtual positions. The depiction is given generically to reflect that in practice the processing is often carried out differently based on the virtualization geometry: for example, for a given virtual source, the signal to the ipsilateral ear (closest to the virtual source) may be presented without any delay while the full ITD is applied to the contralateral ear signal. It should be noted that there are many variations of virtualization based on the ILD/ITD decomposition and that, most generally, the ILD and ITD can both be thought of as being frequency-dependent.

Frequency-domain Virtualization:

The virtualization formulas in Eqs. (1)-(2) can be equivalently expressed in the frequency domain as $$Y_L(\omega) = \sum_m H_{mL}(\omega)X_m(\omega) \tag{3}$$

$$Y_R(\omega) = \sum_m H_{mR}(\omega)X_m(\omega) \tag{4}$$

where $H(\omega)$ denotes the discrete-time Fourier transform (DTFT) of $h[t]$, and $X_m(\omega)$ the DTFT of $x_m[t]$; these can be written equivalently using a magnitude-phase form for the HRTF filters:

$$Y_L(\omega) = \sum_m |H_{mL}(\omega)|X_m(\omega)e^{j\phi_{mL}} \tag{5}$$

$$Y_R(\omega) = \sum_m |H_{mR}(\omega)|X_m(\omega)e^{j\phi_{mP}} \tag{6}$$

where $\phi_{mL}$ and $\phi_{mR}$ are the phases of the respective filters. The interaural phase difference (unwrapped) can be thought of as representing the (frequency-dependent) ITD information:

$$\Delta(\omega) = \frac{1}{(\omega)}(\phi_{mL} - \phi_{mR}) \tag{7}$$

where $\Delta$ denotes the ITD. Alternatively, the ITD may be viewed as represented by the interaural excess-phase difference and any residual phase (e.g. from HRTF measurements) is attributed to acoustic filtering. In this case, each HRTF is decomposed into its minimum-phase component and an all-pass component:

$$H_{mL}(\omega)=F_{mL}(\omega)e^{j\Psi_{mL}(\omega)} \tag{8}$$

$$H_{mR}(\omega)=F_{mR}(\omega)e^{j\Psi_{mR}(\omega)} \tag{9}$$

where $F(\omega)$ is the minimum-phase component and $\Psi(\omega)$ is the excess-phase function. The ITD is then obtained by:

$$\Delta(\omega) = \frac{1}{(\omega)}(\psi_{mL} - \psi_{mR}) \tag{10}$$

Figure 5:
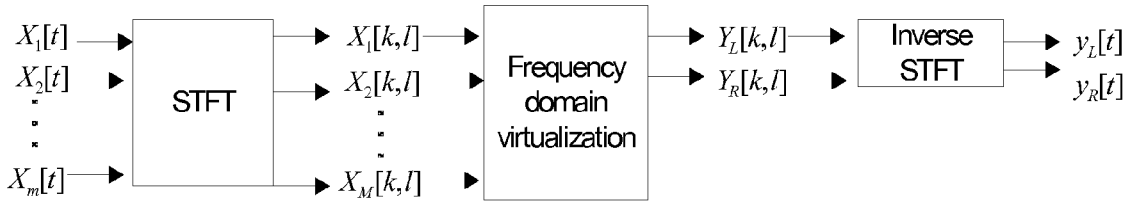
FIG. 5 is a block diagram of a generic frequency-domain virtualization system.

FIG. 5 is a block diagram of a generic frequency-domain virtualization system. The STFT consists of a sliding window and an FFT, while the inverse STFT comprises an inverse FFT and overlap-add.

In the preceding discussion, the frequency-domain formulations are idealized; in practice, frequency-domain implementations are typically based on a short-time Fourier transform (STFT) framework such as that shown in FIG. 5, where the input signal is windowed and the discrete Fourier transform (DFT) is applied to each windowed segment:

$$X_m[k, l] = \sum_{n=0}^{N-1} \omega[n]x_m[n + lT]e^{-j\omega_k n} \tag{11}$$

where k is a frequency bin index, l is a time frame index, $\omega[n]$ is an N-point window, T is the hop size between successive windows, and $$\omega_k = \frac{2\pi k}{K},$$

with K being the DFT size. As in Equations (3, 4), the HRTF filtering is implemented by frequency-domain multiplication and the binaural signals are computed by adding the contributions from the respective virtualized input channels:

$$Y_L[k, l] = \sum_m H_{mL}[k]X_m[k, l] \tag{12}$$

$$Y_R[k, l] = \sum_m H_{mR}[k]X_m[k, l] \tag{13}$$

where $H[k]$ denotes the DFT of $h[t]$. In the STFT architecture, achieving filtering equivalent to the time-domain approach requires that the DFT size be sufficiently large to avoid time-domain aliasing: $K \geqq N+N_h-1$, where $N_h$ is the length of the HRIR. For long filters, the frequency-domain processing can still be implemented with a computationally practical FFT size by applying appropriately derived filters (instead of simple multiplications) to the subband signals or by using a hybrid time-domain/frequency-domain approach.

Frequency-domain processing architectures are of interest for several reasons. First, due to the low cost of the fast Fourier transform (FFT) algorithms used for computing the DFT (and the correspondence of frequency-domain multiplication to time-domain convolution), they provide an efficient alternative to time-domain convolution for long FIR filters. That is, more accurate filtering of input audio can be performed by relatively inexpensive hardware or hardware software combinations in comparison to the more complex processing requirements needed for accurate time domain filtering. Furthermore, HRTF data can be more flexibly and meaningfully parameterized and modeled in a frequency-domain representation than in the time domain.

Limitations of Standard Methods:

In the standard HRTF methods described in the previous sections, sources that are discretely panned to a single channel can be convincingly virtualized over headphones, i.e. a rendering can be achieved that gives a sense of externalization and accurate spatial positioning of the source. However, a sound source that is panned across multiple channels in the recording may not be convincingly reproduced. Consider a set of input signals which each contain an amplitude-scaled version of source s[t]:

$$x_m[t]=\alpha_m s[t] \tag{14}$$

With these inputs, Eq. (1) becomes $$y_L[t] = \sum_m h_{mL}[t] * (\alpha_m s[t]) \tag{15}$$

from which it is clear that in this scenario $$y_L[t] = s[t] * \left(\sum_m \alpha_m h_{mL}[t]\right) \tag{16}$$

$$y_R[t] = s[t] * \left(\sum_m \alpha_m h_{mR}[t]\right). \tag{17}$$

The source s[t] is thus rendered through a combination of HRTFs for multiple different directions instead of via the correct HRTFs for the actual desired source direction, i.e. the due source location in a loudspeaker reproduction compatible with the input format. Unless the combined HRTFs correspond to closely spaced channels, this combination of HRTFs will significantly degrade the spatial image. The methods of various embodiments of the present invention overcome this drawback, as described further in the following section.

Virtualization Based on Spatial Analysis-Synthesis:

Embodiments of the present invention use a novel frequency-domain approach to binaural rendering wherein the input audio scene is analyzed for spatial information, which is then used in the synthesis algorithm to render a faithful and compelling reproduction of the input, scene. A frequency-domain representation provides an effective means to distill a complex acoustic scene into separate sound events so that appropriate spatial processing can be applied to each such event.

FIG. 1 is a flowchart illustrating a generalized stereo virtualization method in accordance with one embodiment of the present invention. Initially, in operation 102, a short term Fourier transform (STFT) is performed on the input signal. For example, the STFT may comprise a sliding window and an FFT. Next, in operation 104, a panning analysis is performed to extract directional information. For each time and frequency, the spatial analysis derives a directional angle representative of the position of the source audio relative to the listener's head and may perform a separation of the input signal into several spatial components (for instance directional and non-directional components). Next, in operation 106, panning-dependent filtering is performed using left and right HRTF filters designed for virtualization at the determined direction angle. After the binaural signals are generated for all frequencies in a given time frame and the various component combined in operation 108 (optionally incorporating a portion of the input signal), time-domain signals for presentation to the listener are generated by an inverse transform and an overlap-add procedure in operation 110.

Figure 2:
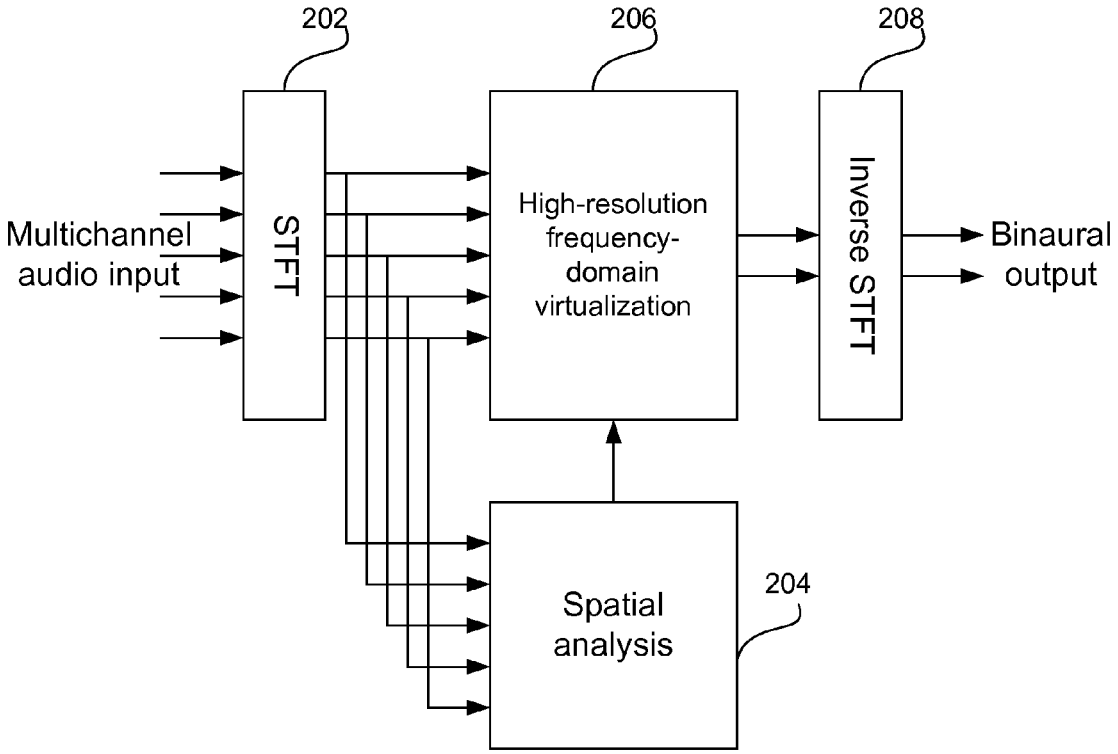
FIG. 2 is a flowchart illustrating a binaural synthesis method for multichannel audio signals in accordance with another embodiment of the present invention.

FIG. 2 is a flowchart illustrating a method for binaural synthesis of multichannel audio in accordance with one embodiment of the present invention. Initially, in operation 202, a short term Fourier transform (STFT) is performed on the input signal, for example a multichannel audio input signal. For example, the STFT may comprise a sliding window and an FFT. Next, in operation 204, a spatial analysis is performed to extract directional information. For each time and frequency, the spatial analysis derives a direction vector representative of the position of the source audio relative to the listener's head. Next, in operation 206, each time-frequency component is filtered preferably based on phase and amplitude differences that would be present in left and right head related transfer function (HRTF) filters derived from the corresponding time-frequency direction vector (provided by block 204). More particularly, at least first and second frequency domain output signals are generated that at each time and frequency component have relative inter-channel phase and amplitude values that characterize a direction in a selected output format. After the at least two output channel signals are generated for all frequencies in a given time frame, time-domain signals for presentation to the listener are generated by an inverse transform and an overlap-add procedure in operation 208.

The spatial analysis method, the binaural synthesis algorithm, and the incorporation of primary-ambient decomposition are described in further detail below.

Spatial Audio Scene Coding:

The spatial analysis method includes extracting directional information from the input signals in the time-frequency domain. For each time and frequency, the spatial analysis derives a direction angle representative of a position relative to the listener's head; for the multichannel case, it furthermore derives a distance cue that describes the radial position relative to the center of a listening circle—so as to enable parametrization of fly-by and fly-through sound events. The analysis is based on deriving a Gerzon vector to determine the localization at each time and frequency:

$$\vec{g}[k, l] = \sum_m \alpha[k, l]\vec{e}_m \tag{18}$$

where $\vec{e}_m$ is a unit vector in the direction of the m-th input channel. An example of these format vectors for a standard 5-channel setup is shown in FIG. 6A. The weights $\alpha_m[k,l]$ in Eq. (18) are given by $$\alpha_m[k, l] = \frac{|X_m[k, l]|}{\sum_{i=1}^{M} |X_i[k, l]|} \tag{19}$$

for the Gerzon velocity vector and $$\alpha_m[k, l] = \frac{|X_m[k, l]|^2}{\sum_{i=1}^{M} |X_i[k, l]|^2} \tag{20}$$

for the Gerzon energy vector, where M is the number of input channels. The velocity vector is deemed more appropriate for determining the localization of low-frequency events (and the energy vector for high frequencies).

FIG. 6A depicts format vectors (601-605) for a standard 5-channel audio format (solid) and the corresponding encoding locus (606) of the Gerzon vector (dotted). FIG. 6B depicts the same for an arbitrary loudspeaker layout. The Gerzon vector 608 and the localization vector 609 are illustrated in FIG. 6A.

While the angle of the Gerzon vector as defined by equations (18) and (19) or (20) can take on any value, its radius is limited such that the vector always lies within (or on) the inscribed polygon whose vertices are at the format vector endpoints (as illustrated by the dotted lines in each of FIG. 6A and FIG. 6B; values on the polygon are attained only for pairwise-panned sources. This limited encoding locus leads to inaccurate spatial reproduction. To overcome this problem and enable accurate and format-independent spatial analysis and representation of arbitrary sound locations in the listening circle, a localization vector $\vec{d}[k,l]$ is computed as follows (where the steps are carried out for each bin k at each time l):

1. Derive the Gerzon vector $\vec{g}[k,l]$ via Eq. (18).
2. Find the adjacent format vectors on either side of $\vec{g}[k,l]$; these are denoted hereafter by $\vec{e}_i$ and $\vec{e}_j$ (where the frequency and time indices k and l for these identified format vectors are omitted for the sake of notation simplicity).
3. Using the matrix $E_{ij}=[\vec{e}_i\,\vec{e}_j]$, compute the radius of the localization vector as $$r[k,l]=\|E_{ij}^{-1}\vec{g}[k,l]\|_1 \tag{21}$$

where the subscript 1 indicates the 1-norm of a vector (i.e. the sum of the absolute values of the vector elements).

4. Derive the localization vector as $$\vec{d}[k,l]=r[k,l]\frac{\vec{g}[k,l]}{\|\vec{g}[k,l]\|_2} \tag{22}$$

where the subscript 2 indicates the Euclidian norm of a vector.

This is encoded in polar form as the radius r[k,l] and an azimuth angle θ [k,l].

Note that the localization vector given in Eq. (22) is in the same direction as the Gerzon vector. Here, though, the vector length is modified by the projection operation in Eq. (21) such that the encoding locus of the localization vector is expanded to include the entire listening circle; pairwise-panned components are encoded on the circumference instead of on the inscribed polygon as for the unmodified Gerzon vector.

The spatial analysis described above was initially developed to provide "universal spatial cues" for use in a format-independent spatial audio coding scheme. A variety of new spatial audio algorithms have been enabled by this robust and flexible parameterization of audio scenes, which we refer to hereafter as spatial audio scene coding (SASC); for example, this spatial parameterization has been used for high-fidelity conversion between arbitrary multichannel audio formats. Here, the application of SASC is provided in the frequency-domain virtualization algorithm depicted in FIG. 5. In this architecture, the SASC spatial analysis is used to determine the perceived direction of each time-frequency component in the input audio scene. Then, each such component is rendered with the appropriate binaural processing for virtualization at that direction; this binaural spatial synthesis is discussed in the following section.

Although the analysis was described above based on an STFT representation of the input signals, the SASC method can be equally applied to other frequency-domain transforms and subband signal representations. Furthermore, it is straightforward to extend the analysis (and synthesis) to include elevation in addition to the azimuth and radial positional information.

Figure 7:
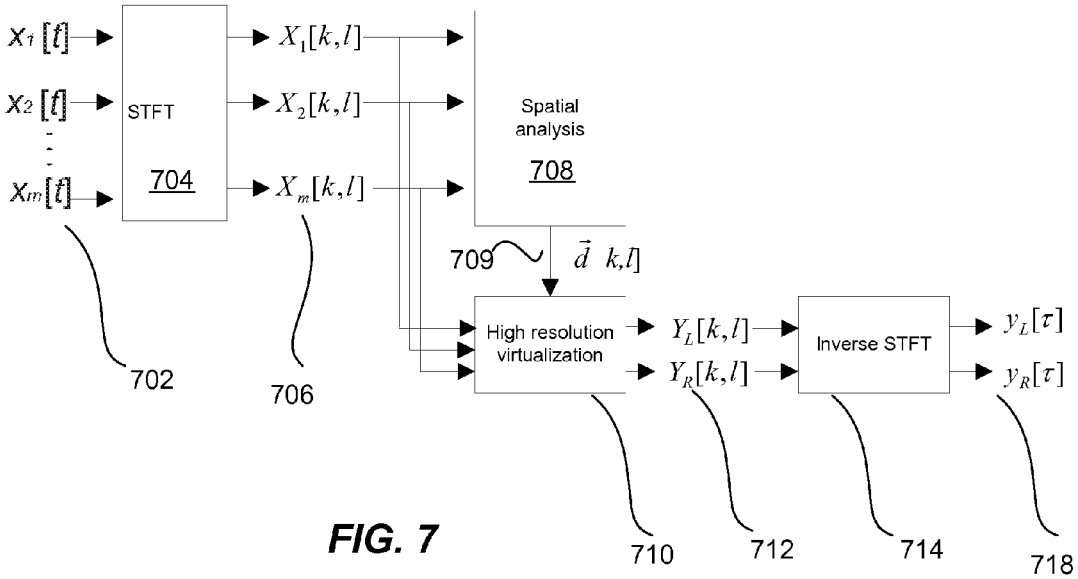
FIG. 7 is a block diagram of a high-resolution frequency-domain virtualization algorithm in accordance with one embodiment of the present invention.

Spatial Synthesis:

In the method embodiments including the virtualization algorithm, the signals $X_m[k,l]$ and the spatial localization vector $\vec{d}[k,l]$ are both provided to the binaural synthesis engine as shown in FIG. 7. In the synthesis, frequency-domain signals $Y_L[k,l]$ and $Y_R[k,l]$ are generated based on the cues $\vec{d}[k,l]$ such that, at each time and frequency, the correct HRTF magnitudes and phases are applied for virtualization at the direction indicated by the angle of $\vec{d}[k,l]$. The processing steps in the synthesis algorithm are as follows and are carried out for each frequency bin k at each time l:

1. For the angle cue θ[k,l] (corresponding to the localization vector $\vec{d}[k,l]$), determine the left and right HRTF filters needed for virtualization at that angle:

$$H_L[k,l]=F_L[k,l]e^{-jw_k\tau_L[k,l]} \tag{23}$$

$$H_R[k,l]=F_R[k,l]e^{-jw_k\tau_R[k,l]} \tag{24}$$

where the HRTF phases are expressed here using time delays $\tau_L[k,l]$ and $T_R[k,l]$. The radial cue r[k,l] can also be incorporated in the derivation of these HRTFs as an elevation or proximity effect, as described below.

2. For each input signal component $X_m[k,l]$, compute binaural signals:

$$Y_{mL}[k,l]=H_L[k,l]X_m[k,l] \tag{25}$$

$$Y_{mR}[k,l]=H_R[k,l]X_m[k,l] \tag{26}$$

3. Accumulate the final binaural output signals:

$$Y_L[k,l]=\sum_{m=1}^{M}Y_{mL}[k,l] \tag{27}$$

$$Y_R[k,l]=\sum_{m=1}^{M}Y_{mR}[k,l]. \tag{28}$$

After the binaural signals are generated for all k for a given frame l, time-domain signals for presentation to the listener are generated by an inverse transform and overlap-add as shown in FIG. 7. FIG. 7 is a block diagram of a high-resolution frequency-domain virtualization algorithm where Spatial Audio Scene Coding is used to determine the virtualization directions for each time-frequency component in the input audio scene. Input signals 702 are converted to the frequency domain representation 706, preferably but not necessarily using a Short Term Fourier Transform 704. The frequency-domain signals are preferably analyzed in spatial analysis block 708 to generate at least a directional vector 709 for each time-frequency component. It should be understood that embodiments of the present invention are not limited to methods where spatial analysis is performed, or, even in method embodiments where spatial analysis is performed, to a particular spatial analysis technique. One preferred method for spatial analysis is described in further detail in copending application Ser. No. 11/750,300, filed May 17, 2007, titled "Spatial Audio Coding Based on Universal Spatial Cues (incorporated by reference).

Next, the time-frequency signal representation (frequency-domain representation) 706 is further processed in the high resolution virtualization block 710. This block achieves a virtualization effect for the selected output format channels 718 by generating at least first and second frequency domain signals 712 from the time frequency signal representation 706 that, for each time and frequency component, have inter-channel amplitude and phase differences that characterize the direction that corresponds to the directional vector 709. The first and second frequency domain channels are then converted to the time domain, preferably by using an inverse Short Term Fourier Transform 714 along with conventional overlap and add techniques to yield the output format channels 718.

In the formulation of Equations (25, 26), each time frequency component $X_m[k,l]$ is independently virtualized by the HRTFs. It is straightforward to manipulate the final synthesis expressions given in Equations (27, 28) to yield $$Y_L[k,l] = \left[\sum_{m=1}^{M} X_m[k,l]\right] F_L[k,l] e^{-jw_k \tau_L[k,l]} \tag{29}$$

$$Y_R[k,l] = \left[\sum_{m=1}^{M} X_m[k,l]\right] F_R[k,l] e^{-jw_k \tau_R[k,l]} \tag{30}$$

which show that it is equivalent to first form a down-mix of the input channels and then carry out the virtualization. Since undesirable signal cancellation can occur in the downmix, a normalization is introduced in a preferred embodiment of the invention to ensure that the power of the downmix matches that of the multichannel input signal at each time and frequency.

The frequency-domain multiplications by $F_L[k,l]$ and $F_R[k,l]$ correspond to filtering operations, but here, as opposed to the cases discussed earlier, the filter impulse responses are of length K; due to the nonlinear construction of the filters in the frequency domain (based on the different spatial analysis results for different frequency bins), the lengths of the corresponding filter impulse responses are not constrained. Thus, the frequency-domain multiplication by filters constructed in this way always introduces some time-domain aliasing since the filter length and the DFT size are equal, i.e. there is no zero padding for the convolution. Listening tests indicate that this aliasing is inaudible and thus not problematic, but, if desired, it could be reduced by time-limiting the filters $H_L[k,l]$ and $H_R[k,l]$ at each time l, e.g. by a frequency-domain convolution with the spectrum of a sufficiently short time-domain window. This convolution can be implemented approximately (as a simple spectral smoothing operation) to save computation. In either case, the time-limiting spectral correction alters the filters $H_L[k,l]$ and $H_R[k,l]$ at each bin k and therefore reduces the accuracy of the resulting spatial synthesis.

Finding appropriate filters $H_L[k,l]$ and $H_R[k,l]$ in step 1 of the spatial synthesis algorithm corresponds to determining HRTFs for an arbitrary direction $\theta[k,l]$. This problem is also encountered in interactive 3-D positional audio systems. In one embodiment, the magnitude (or minimum-phase) component of $H_L[k,l]$ and $H_R[k,l]$ is derived by spatial interpolation at each frequency from a database of HRTF measurements obtained at a set of discrete directions. A simple linear interpolation is usually sufficient. The ITD is reconstructed separately either by a similar interpolation from measured ITD values or by an approximate formula. For instance, the spherical head model with diametrically opposite ears and radius b yields $$\Delta[k,l] = \frac{b}{c}(\theta[k,l] + \sin\theta[k,l]) \tag{31}$$

where c denotes the speed of sound, and the azimuth angle $\theta[k,l]$ is in radians referenced to the front direction. This separate interpolation or computation of the ITD is critical for high-fidelity virtualization at arbitrary directions.

After the appropriate ITD $\Delta[k,l]$ is determined as described above, the delays $\tau_L[k,l]$ and $\tau_R[k,l]$ needed in Equations (23, 24) are derived by allocating the ITD between the left and right signals. In a preferred embodiment:

$$\tau_L[k,l] = \tau_o + \frac{\Delta[k,l]}{2} \tag{32}$$

$$\tau_R[k,l] = \tau_o - \frac{\Delta[k,l]}{2} \tag{33}$$

where the offset $\tau_o$ are introduced to allow for positive and negative delays on either channel. Using such an offset results in a more robust frequency-domain modification than the alternative approach where an ipsilateral/contralateral decision is made for each time-frequency component and only positive delays are used.

For broadband transient events, the introduction of a phase modification in the DFT spectrum can lead to undesirable artifacts (such as temporal smearing). Two provisions are effective to counteract this problem. First, a low cutoff can be introduced for the ITD processing, such that high-frequency signal structures are not subject to the ITD phase modification; this has relatively little impact on the spatial effect since ITD cues are most important for localization or virtualization at mid-range frequencies. Second, a transient detector can be incorporated; if a frame contains a broadband transient, the phase modification can be changed from a per-bin phase shift to a broadband delay such that the appropriate ITD is realized for the transient structure. This assumes the use of sufficient oversampling in the DFT to allow for such a signal delay. Furthermore, the broadband delay can be confined to the bins exhibiting the most transient behavior—such that the high-resolution virtualization is maintained for stationary sources that persist during the transient.

Elevation and Proximity Effects:

When applied to multichannel content, the SASC analysis described earlier yields values of the radial cue such that r[k,l]=1 for sound sources or sound events that are pairwise panned (on the circle) and r[k,l]<1 for sound events panned "inside the circle." When r[k,l]=0, the localization of the sound event coincides with the reference listening position. In loudspeaker reproduction of a multichannel recording in a horizontal-only (or "pantophonic") format, such as the 5.1 format illustrated in FIG. 6A, a listener located at the reference position (or "sweet spot") would perceive a sound located above the head (assuming that all channels contain scaled copies of a common source signal). A binaural reproduction of this condition can be readily achieved by feeding the same source signal equally to the two ears, after filtering it with an HRTF filter corresponding to the zenith position (elevation angle=90°). This suggests that, for pantophonic multichannel recordings, the SASC-based binaural rendering scheme can be extended to handle any value of the radial cue r[k,l] by mapping this cue to an elevation angle γ:

$$\gamma[k,l] = S(r[k,l]) \tag{34}$$

where the elevation mapping function S maps the interval [0, 1] to [π/2, 0]. In one embodiment, this mapping function is given (in radians) by $$S(r[k,l])=\arccos(r[k,l]). \tag{35}$$

This solution assumes that the SASC localization vector $\vec{d}[k,l]$ is the projection onto the horizontal plane of a virtual source position (defined by the azimuth and elevation angles θ[k,l] and γ[k,l]) that spans a 3-D encoding surface coinciding with the upper half of a sphere centered on the listener. A more general solution is defined as any 3-D encoding surface that preserves symmetry around the vertical axis and includes the circumference of the unit circle as its edge. For instance, assuming that the 3-D encoding surface is a flattened or "deflated" version of the sphere will prevent small errors in the estimate of r[k,l] from translating to noticeable spurious elevation effects in the binaural rendering of the spatial scene.

In one embodiment, an additional enhancement for r[k,l]<1 consists of synthesizing a binaural near-field effect so as to produce a more compelling illusion for sound events localized in proximity to the listener's head (approximately 1 meter or less). This involves mapping r[k,l] (or the virtual 3-D source position defined by the azimuth and elevation angles θ[k,l] and γ[k,l]) to a physical distance measure, and extending the HRTF database used in the binaural synthesis described earlier to include near-field HRTF data. An approximate near-field HRTF correction can be obtained by appropriately adjusting the interaural level difference for laterally localized sound sources. The gain factors $\beta_L$ and $\beta_R$ to be applied at the two ears may be derived by splitting the interaural path length difference for a given ITD value:

$$\beta_L[k,l]=\frac{2p}{2p+c\Delta[k,l]} \tag{36}$$

$$\beta_R[k,l]=\frac{2p}{2p-c\Delta[k,l]} \tag{37}$$

where p denotes the physical distance from the source to the (center of the) head, and the ITD approximation of Eq. (31) can be extended to account for the elevation angle γ[k,l] as follows:

$$\Delta[k,l]=\frac{b}{c}[\arcsin(\cos\gamma[k,l]\sin\theta[k,l])+\cos\gamma[k,l]\sin\theta[k,l]]. \tag{38}$$

In these formulations, positive angles are in the clockwise direction and a positive ITD corresponds the right ear being closer to the source (such that the left-ear signal is delayed and attenuated with respect to the right).

For three-dimensional (or "periphonic") multichannel loudspeaker configurations, the SASC localization vector $\vec{d}[k,l]$ derived by the spatial analysis readily incorporates elevation information, and r[k,l] may be interpreted merely as a proximity cue, as described above.

Figure 8:
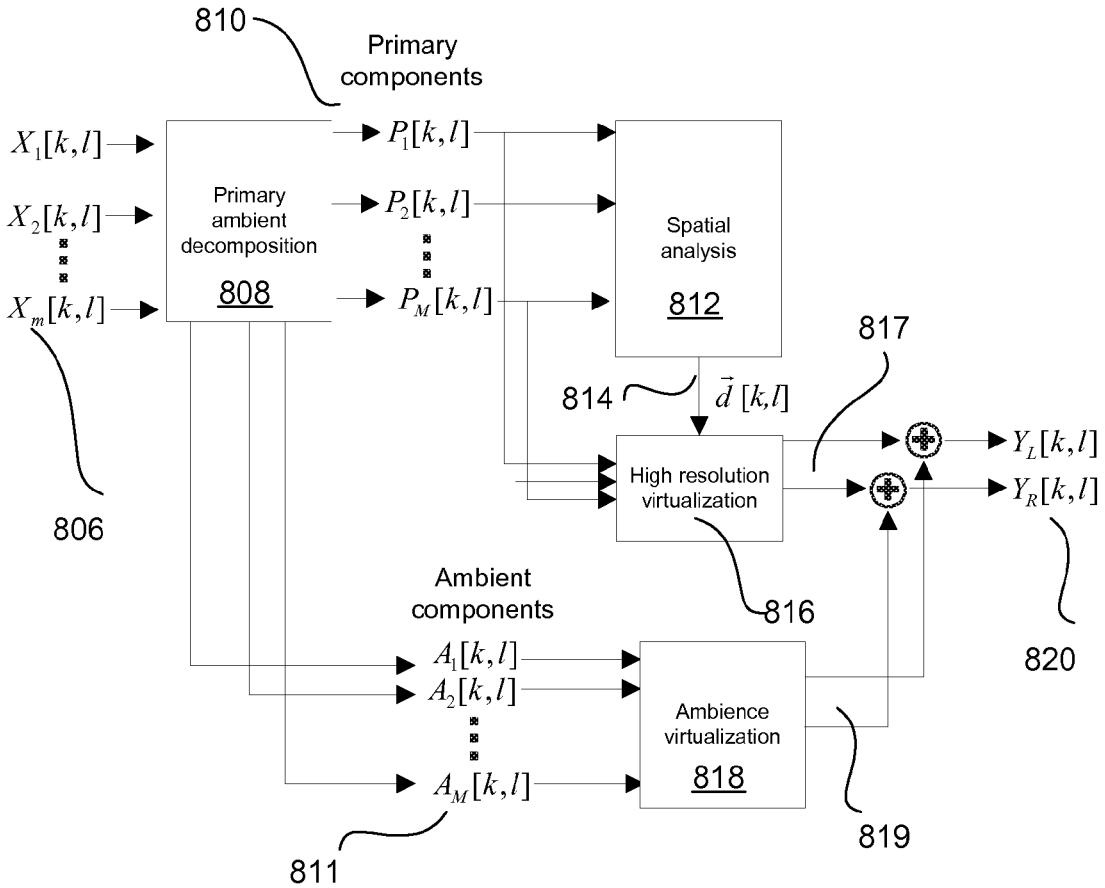
FIG. 8 is a block diagram of a high-resolution frequency-domain virtualization system with primary-ambient signal decomposition in accordance with one embodiment of the present invention.

Primary-ambient Decomposition:

In synthesizing complex audio scenes, different rendering approaches are needed for discrete sources and diffuse sounds; discrete or primary sounds should be rendered with as much spatialization accuracy as possible, while diffuse or ambient sounds should be rendered in such a way as to preserve (or enhance) the sense of spaciousness associated with ambient sources. For that reason, the SASC scheme for binaural rendering is extended here to include a primary-ambient signal decomposition as a front-end operation, as shown in FIG. 8. This primary-ambient decomposition separates each input signal $X_m[k,l]$ into a primary signal $P_m[k,l]$ and an ambience signal $A_m[k,l]$; several methods for such decomposition have been proposed in the literature.

FIG. 8 is a block diagram of a high-resolution frequency-domain virtualization system with primary-ambient signal decomposition, where the input and output time-frequency transforms are not depicted. Initially, the frequency domain input signals 806 are processed in primary-ambient decomposition block 808 to yield primary components 810 and ambient components 811. In this embodiment, spatial analysis 812 is performed on the primary components to yield a directional vector 814. Preferably, the spatial analysis is performed in accordance with the methods described in copending application, U.S. Ser. No. 11/750,300. Alternatively, the spatial analysis is performed by any suitable technique that generates a directional vector from input signals. Next, the primary component signals 810 are processed in high resolution virtualization block 816, in conjunction with the directional vector information 814 to generate frequency domain signals 817 that, for each time and frequency component, have inter-channel amplitude and phase differences that characterize the direction that corresponds to the directional vector 814. Ambience virtualization of the ambience components 811 takes place in the ambience virtualization block 818 to generate virtualized ambience components 819, also a frequency domain signal. Since undesirable signal cancellation can occur in a downmix, relative normalization is introduced in a preferred embodiment of the invention to ensure that the power of the downmix matches that of the multichannel input signal at each time and frequency. The signals 817 and 819 are then combined.

After the primary-ambient separation, virtualization is carried out independently on the primary and ambient components. The spatial analysis and synthesis scheme described previously is applied to the primary components $P_m[k,l]$. The ambient components $A_m[k,l]$, on the other hand, may be suitably rendered by the standard multichannel virtualization method described earlier, especially if the input signal is a multichannel surround recording, e.g. in 5.1 format.

In the case of a two-channel recording, it is desirable to virtualize the ambient signal components as a surrounding sound field rather than by direct reproduction through a pair of virtual frontal loudspeakers. In one embodiment, the ambient signal components $A_L[k,l]$ and $A_R[k,l]$ are directly added into the binaural output signal ($Y_L[k,l]$ and $Y_R[k,l]$) without modification, or with some decorrelation filtering for an enhanced effect. An alternative method consists of "upmixing" this pair of ambient signal components into a multichannel surround ambience signal and then virtualizing this multichannel signal with the standard techniques described earlier. This ambient upmixing process preferably includes applying decorrelating filters to the synthetic surround ambience signals.

Applications:

The proposed SASC-based rendering method has obvious applications in a variety of consumer electronic devices where improved headphone reproduction of music or movie soundtracks is desired, either in the home or in mobile scenarios. The combination of the spatial analysis method described in U.S. patent application Ser. No. 11/750,300 ("Spatial Audio Coding Based on Universal Spatial Cues", incorporated by reference herein) with binaural synthesis performed in the frequency domain provides an improvement in the spatial quality of reproduction of music and movie soundtracks over headphones. The resulting listening experience is a closer approximation of the experience of listening to a true binaural recording of the recorded sound scene (or of a given loudspeaker reproduction system in an established listening room). Furthermore, unlike a conventional binaural recording, this reproduction technique readily supports head-tracking compensation because it allows simulating a rotation of the sound scene with respect to the listener, as described below. While not intended to limit the scope of the present invention, several additional applications of the invention are described below.

Spatial Audio Coding Formats:

The SASC-based binaural rendering embodiments described herein are particularly efficient if the input signal is already provided in the frequency domain, and even more so if it is composed of more than two channels—since the virtualization then has the effect of reducing the number of channels requiring an inverse transform for conversion to the time domain. As a common example of this computationally favorable situation, the input signals in standard audio coding schemes are provided to the decoder in a frequency-domain representation; similarly, this situation occurs in the binaural rendering of a multichannel signal represented in a spatial audio coding format. In the case of the SASC format described in copending U.S. patent application Ser. No. 11/750,300, the encoder already provides the spatial analysis (described earlier), the downmix signal, and the primary-ambient decomposition. The spatial synthesis methods described above thus form the core of a computationally efficient and perceptually accurate headphone decoder for the SASC format.

Non-discrete Multichannel Formats:

The SASC-based binaural rendering method can be applied to other audio content than standard discrete multichannel recordings. For instance, it can be used with ambisonic-encoded or matrix-encoded material. In combination with the SASC-based matrix decoding algorithm described in copending U.S. Patent Application Ser. No. 61/102,002 and entitled Phase-Amplitude 3-D Stereo Encoder and Decoder, the binaural rendering method proposed here provides a compatible and effective approach for headphone reproduction of two-channel matrix-encoded surround content. Similarly, it can be readily combined with the SIRR or DirAC techniques for high-resolution reproduction of ambisonic recordings over headphones or for the conversion of room impulse responses from an ambisonic format to a binaural format.

Spatial Transformation:

The SASC-based binaural rendering method has many applications beyond the initial motivation of improved headphone listening. For instance, the use of the SASC analysis framework to parameterize the spatial aspects of the original content enables flexible and robust modification of the rendered scene. One example is a "wraparound" enhancement effect created by warping the angle cues so as to spatially widen the audio scene prior to the high-resolution virtualization. Given that spatial separation is well known to be an important factor in speech intelligibility, such spatial widening may prove useful in improving the listening assistance provided by hearing aids.

Scene Rotation and Head-tracking:

In addition to spatial widening, other modes of content redistribution or direction-based enhancement are also readily achievable by use of the SASC-based binaural rendering method described herein. One particularly useful redistribution is that of a scene rotation; because it enables accurately synthesizing a rotation of the sound scene with respect to the listener, the reproduction method described herein, unlike a conventional virtualizer or binaural recording, readily supports head-tracking compensation. Indeed, SASC-based binaural rendering enables improved head-tracked binaural virtualization compared to standard channel-centric virtualization methods because all primary sound components are reproduced with accurate HRTF cues, avoiding any attempt to virtualize "phantom image" illusions of sounds panned between two or more channels.

Loudspeaker Reproduction:

The SASC-based binaural rendering method can be incorporated in a loudspeaker reproduction scenario by introducing appropriate crosstalk cancellation filters applied to the binaural output signal. For a more efficient implementation, it is also possible to combine the binaural synthesis and the cross-talk cancellation in the frequency-domain synthesis filters $H_L[k,l]$ and $H_R[k,l]$, using known HRTF-based or "transaural" virtualization filter design techniques.

Generalization to Arbitrary Spatial Audio Format Conversion:

While the above description of preferred embodiments SASC-based binaural rendering method assumes reproduction using a left output channel and a right output channel, it is straightforward to apply the principles of the present invention more generally to spatial audio reproduction over headphones or loudspeakers using any 2-channel or multi-channel audio recording or transmission format where the direction angle can be encoded in the output signal by prescribed frequency-dependent or frequency-independent inter-channel amplitude and/or phase differences. Therefore, the present invention allows accurate reproduction of the spatial audio scene in, for instance, an ambisonic format, a phase-amplitude matrix stereo format; a discrete multi-channel format, a conventional 2-channel or multi-channel recording format associated to array of two or more microphones, a 2-channel or multi-channel loudspeaker 3D audio format using HRTF-based (or "transaural") virtualization techniques, or a sound field reproduction method using loudspeaker arrays, such as Wave Field Synthesis.

As is apparent from the above description, the present invention can be used to convert a signal from any 2-channel or multi-channel spatial audio recording or transmission format to any other 2-channel or multi-channel spatial audio recording or transmission format. Furthermore, the method allows including in the format conversion an angular transformation of the sound scene such as a rotation or warping applied to the direction angle of sound components in the sound scene.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of generating an audio output signal having at least first and second audio output channels from a time-frequency signal representation of an audio input signal having at least one audio input channel and at least one spatial information input channel, comprising:

selecting a spatial audio output format such that a direction in the audio output signal is characterized by at least one of an inter-channel amplitude difference and an inter-channel phase difference at each frequency between the at least first and second audio output channels;

receiving directional information corresponding to each of a plurality of frames of the time-frequency signal representation, wherein directional information is derived by decomposing the audio input signal into primary and ambient components and performing a spatial analysis on at least a time-frequency representation of the primary components; and generating first and second frequency domain output signals from the directional information and the time-frequency signal representation that, at each time and frequency, have inter-channel amplitude and phase differences between the at least first and second audio output channels that characterize a direction in the spatial audio output format.

2. The method as recited in claim 1 further comprising receiving a radius value corresponding to each of a plurality of frames of the time-frequency signal representation, each of said radius values corresponding to the distance from an analyzed audio source to the listener or to the elevation of an analyzed audio source relative to the horizontal plane.

3. The method as recited in claim 1 wherein the audio input signal is one of an ambisonic or phase-amplitude matrix encoded signal.

4. The method as recited in claim 1 wherein the audio input signal is a stereo signal.

5. The method as recited in claim 1 further comprising performing a normalization to ensure that the power of the audio output channels matches that of the audio input signal at each time and frequency.

6. The method as recited in claim 1 where the audio output signal is intended for reproduction using headphones or loudspeakers.

7. The method as recited in claim 1 where an inter-channel amplitude and phase difference is derived at each frequency and for a plurality of directions from measured or computed HRTF or BRTF data.

8. The method as recited in claim 1 where the directional information is corrected according to the orientation or position of a corresponding listener's head.

9. The method as recited in claim 1 where the spatial audio output format is one of a transaural, an ambisonic or a phase-amplitude matrix encoded format.

10. The method as recited in claim 1 where the audio output signal is intended for reproduction using loudspeakers and an inter-channel amplitude and phase difference is derived at each frequency and for a plurality of directions according to one of an ambisonic reproduction or a wave-field synthesis method.

11. A method of generating an audio output signal having at least first and second audio output channels from a time-frequency signal representation of an audio input signal having at least one audio input channel and at least one spatial information input channel, comprising:

selecting a spatial audio output format such that a direction in the audio output signal is characterized by at least one of an inter-channel amplitude difference and an inter-channel phase difference at each frequency between the at least first and second audio output channels;

receiving an ambient directional vector corresponding to at least one ambient component of the audio input signal, receiving a time-frequency representation of ambient components corresponding to the audio input signal, and using the ambient directional vector and ambient components to generate the first and second frequency domain output signals that, at each time and frequency, have inter-channel amplitude and phase differences between the at least first and second audio output channels that characterize a direction in the spatial audio output format.

12. A method of generating a binaural audio signal, comprising:

converting an input audio signal to a frequency domain representation;

decomposing the input audio signal into primary and ambient components and performing a spatial analysis on at least a time frequency representation of the primary components to derive a directional vector having direction angle information, the directional vector corresponding to the localization direction of each of a plurality of time frequency components from the frequency domain representation;

generating first and second frequency domain signals from the frequency domain representation that, at each time and frequency, have inter-channel amplitude and phase differences that characterize a direction that corresponds to the directional vector; and performing an inverse transform to convert the frequency domain signals.

* * * * *